United States Patent [19]

Kawamura

[11] 4,383,654

[45] May 17, 1983

[54] TRAVERSE DRUM FOR WINDING MACHINE

[75] Inventor: Shuzo Kawamura, Joyo, Japan

[73] Assignee: Murata Kikai Kabushiki Kaisha, Kyoto, Japan

[21] Appl. No.: 280,461

[22] Filed: Jul. 6, 1981

[30] Foreign Application Priority Data

Jul. 4, 1980 [JP] Japan ..... 55-91865

[51] Int. Cl.[3] ..... B65H 54/28; B65H 54/48

[52] U.S. Cl. ..... 242/43.2

[58] Field of Search ..... 242/43.2, 158.5

[56] References Cited

U.S. PATENT DOCUMENTS 3,147,930 9/1964 Fossen et al. ..... 242/43.2

FOREIGN PATENT DOCUMENTS 1074269 3/1954 France ..... 242/43.2

55-2506 1/1980 Japan ..... 242/43.2

*Primary Examiner*—Stanley N. Gilreath

*Attorney, Agent, or Firm*—Moonray Kojima

[57] ABSTRACT

A traverse drum for a winding machine having an endless guide groove extending about and along a peripheral surface of the drum body. At the crossing zone of the guide groove, one of the groove is formed to be a deep groove and the other is formed to be a shallow groove which has a side wall having gentler inclined side wall than the confronting side wall of the shallow groove and a wound yarn-removing notch is formed on the shallow groove.

3 Claims, 4 Drawing Figures

TRAVERSE DRUM FOR WINDING MACHINE

BACKGROUND OF THE INVENTION

In an ordinary yarn winding machine, there is used a traverse drum which drives a winding package by contact with the surface of the winding package and traverses a yarn from side to side. An endless guide groove is formed on this traverse drum and the yarn is traversed from side to side along this groove. When yarn breakage takes place between the winding package on the drum and the traverse drum, the yarn end on the package side is wound on the package but the yarn end on the cop side is occasionally wound and caught on the drum groove of the traverse drum by the force of inertia and the static electricity generated on the surface of the drum. Furthermore, because of such a property of the yarn that the yarn tends to travel along the shortest distance, the yarn is often wound on the groove in the vicinity of the center of the drum. Such yarn wound and caught on the drum groove should be removed immediately after stopping of the drum.

The yarn wound on the groove bottom of the drum cannot be removed by hand without using any tool, and since this removal should be performed by inserting a knife or the like into the groove, there is a risk of damage to the side wall or bottom wall of the groove. Of course, the surface of the drum and the yarn contact surface of the drum groove are finished very smoothly so that fibers are not caught or scratched on such surface. Accordingly, if the yarn contact surface is damaged, yarn breakage is occasionally induced during the winding operation.

SUMMARY OF THE INVENTION

The present invention relates to a traverse drum for a yarn winding machine.

It is a primary object of the present invention to eliminate the aforementioned disadvantage and provide a traverse drum having a wound yarn removing notch which can facilitate removal of wound yarns without any damage to the yarn contact surfaces of drum grooves and which does not constitute any hindrance to the ordinary winding operation.

A guide groove is formed to be extending about and along a peripheral surface of a drum body. According to the present invention, of shallow grooves which are cut and traversed by a continuous deep groove in a guide groove crossing zone of the traverse drum, the shallow groove on the yarn delivery side has a gently inclined surface formed on the yarn guiding side wall thereof, a part of this inclined surface is extended toward the deep groove beyond a straight line which is in a plane perpendicular to the drum axis, which is drawn down from the end of the other shallow groove, and at the position of this extended part, a notch traversing the guide grooves and having a bottom surface lower than the bottom surfaces of the guide grooves is formed. By virtue of adoption of this characteristic structure, in the present invention, the yarn is not caught by the above-mentioned notch while the yarn is delivered between the cut shallow grooves, that is, the yarn extended from the end of the shallow groove to the cop is first brought in contact with the guide edge beyond the notch of the shallow groove on the yarn delivery side, and therefore, the notch does not constitute any hindrance to the delivery of the yarn. Furthermore, since the notch is formed over the region of the lower ends of the groove side wall and the guiding side wall to the upper edges thereof, the guiding side wall is prevented from being damaged at the operation of cutting and removing the wound yarn.

DETAILED DESCRIPTION OF THE INVENTION

The present invention will now be described in detail with reference to an embodiment illustrated in the accompanying drawings.

Figure 1:
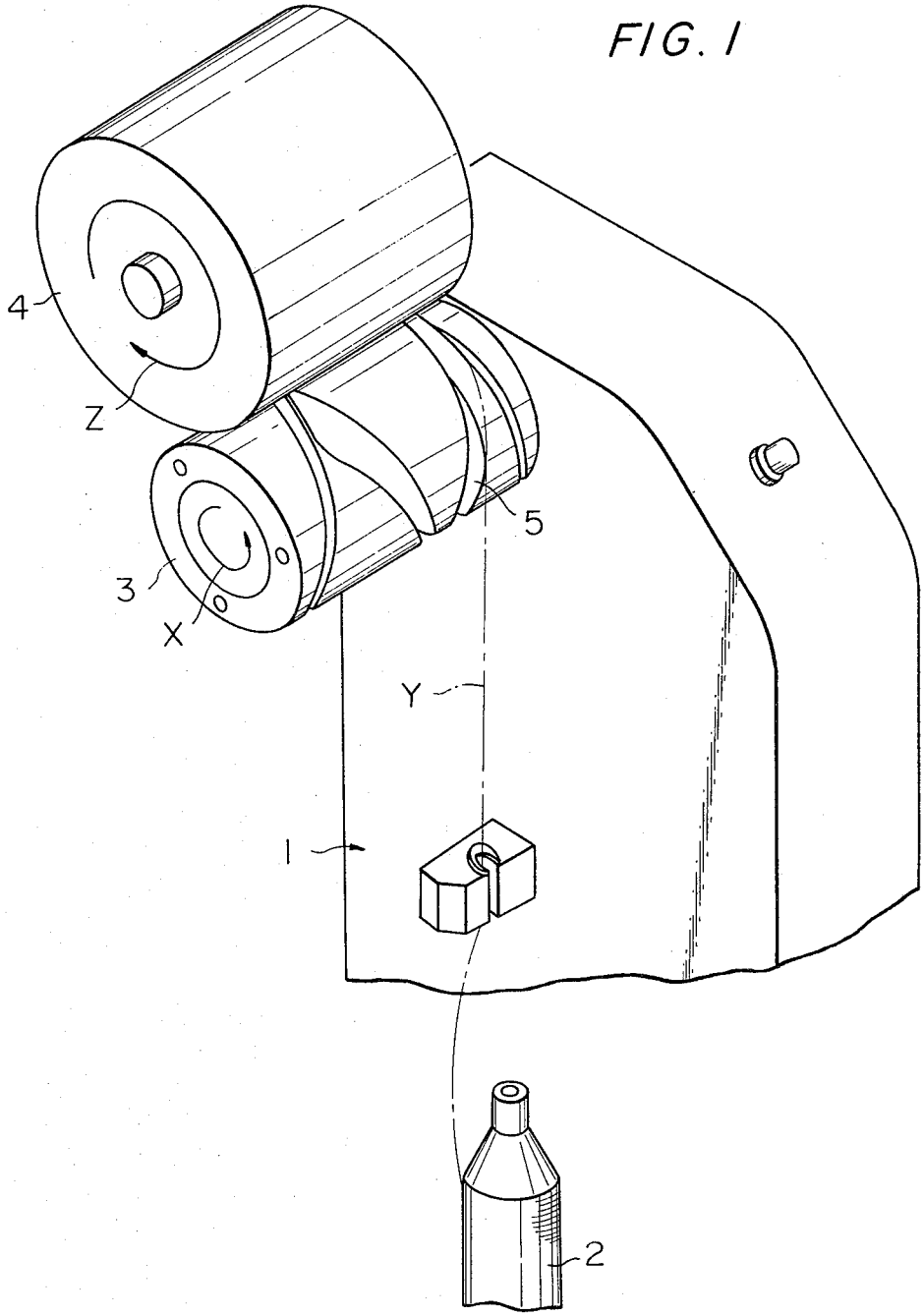
FIG. 1 is a perspective view showing a winding zone of a yarn winding machine.

Referring to FIG. 1 diagrammatically illustrating the structure of a winding zone in a yarn winding machine, a yarn Y taken out from a cop 2 supplied to a winding unit 1 is passed through a tensor, a slub catcher and a guide (not shown) and wound on a package 4 rotated by surface contact with a traverse drum 3 while the yarn Y is being traversed from side to side.

The yarn Y is introduced into a drum groove 5 from the front portion of the traverse drum 3, and while the yarn Y is being guided by the side wall of the groove, the yarn Y is traversed and is pressed to the drum surface by rotation of the drum 3 in a direction indicated by an arrow X. Then, the yarn Y is wound on the package 4 rotated in a direction indicated by an arrow Z.

Figure 2:
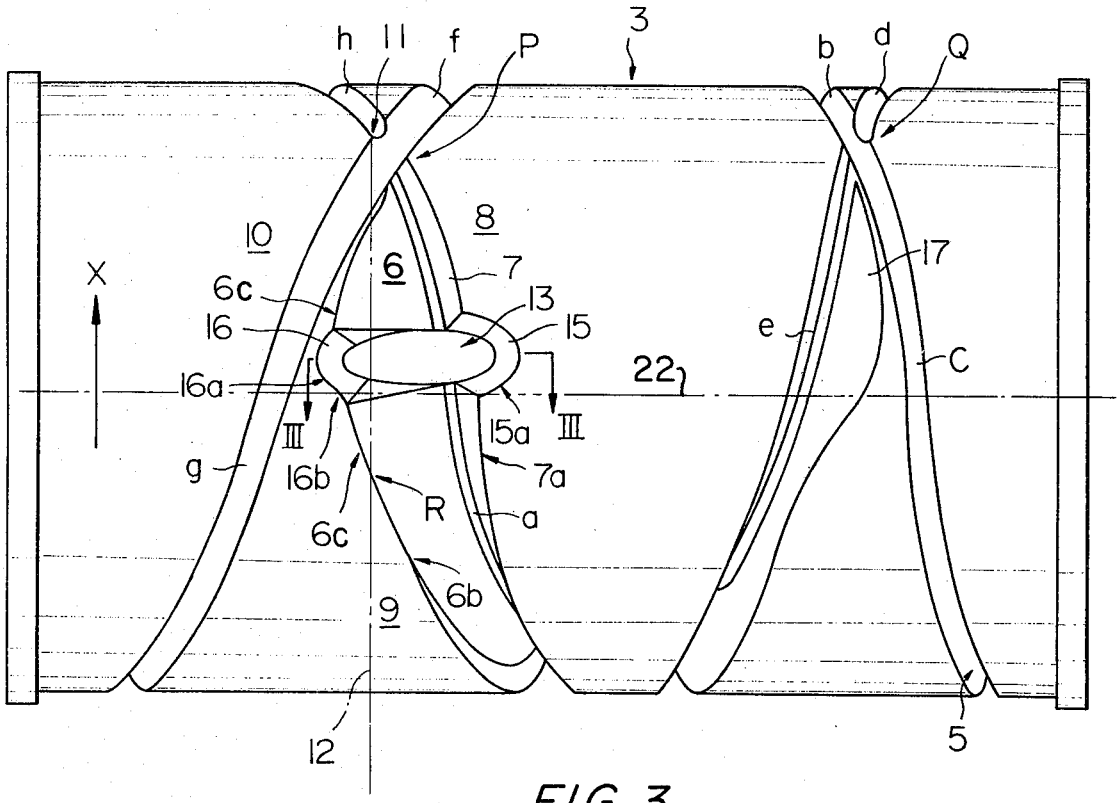
FIG. 2 is a front view showing one embodiment of the traverse drum according to the present invention.

An embodiment of the traverse drum 3 is illustrated in FIG. 2. More specifically, a 2-wind type traverse drum which makes two rotations during one traverse of the yarn is shown in FIG. 2. Of course, a 1.5-wind type or 2.5-wind type traverse drum may be used in the present invention. A groove 5 is formed deeply or shallowly on the peripheral surface of the traverse drum 3 so that the groove 5 crosses at three points on the drum surface. More specifically, there are crossing points P and Q shown in FIG. 2 and a crossing point (not shown) on the back surface side. At the crossing point P, grooves "a" and "h" are shallow, and grooves "f" and "g" are deep and they are contiguous to each other, while the shallow grooves "h" and "a" are cut by the deep grooves "f" and "g". Also at the crossing point Q, deep grooves "b" and "c" traverse shallow grooves "d" and "e".

Figure 3:
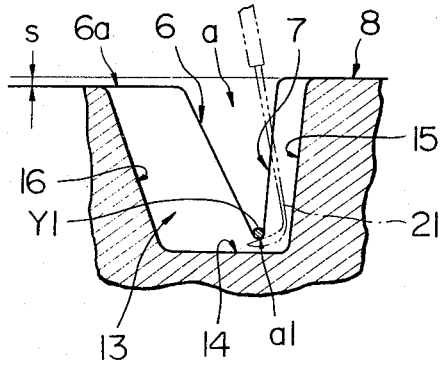
FIG. 3 is a view showing the section taken along the line III—III in FIG. 2.

At the crossing point P, a side wall 6 on the side of the shallow groove "a" has a surface having a gentler inclination than the inclination of the surface of a side wall 7, and as shown in FIG. 3, the top edge 6*a* of this side wall 6 is located at a position lower than other drum surfaces 8, 9 and 10. Furthermore, the side wall 6 is elongated toward the side of the deep groove "g" beyond a straight line 12 which is in a plane perpendicular to the drum axis 22, which is drawn from the end 11 of the shallow groove "h". More specifically, the side wall 6 is formed so that when the drum 3 is rotated in a direction indicated by the arrow X in FIG. 2, the traverse direction of the yarn traversed along the shallow grooves "h" and "a" is the left-to-right direction, and when the yarn is delivered from the shallow groove end 11 to the shallow groove "a" beyond the deep grooves "f" and "g", this delivery can be facilitated. Fan-shaped areas 6c defined by the straight line 12 are not brought into contact with the yarn.

A wound yarn-removing notch 13 is formed so that it traverses the shallow groove "a". As shown in FIG. 3, the bottom surface 14 of the notch 13 is located below the bottom "a1" of the shallow groove "a" and traverses the shallow groove "a" at this position. The side wall 15 of the notch 13 intrudes into the interior of the drum from the inclined wall surface 7 of the groove "a" to form a recess. The upper edge 15a of the side wall 15 coincides with the drum surface 8. Also the other side wall 16 of the notch 13 intrudes into the interior of the drum from the gently inclined wall surface 6 to form a recess, and the top edge 16a of the side wall 16 coincides with the drum surface 9. The notch 13 is formed so that the upper edge 16a of the side wall 16 of the notch is located on the left side of the straight line 12. This straight line 12 is a straight line drawn from the shallow groove end 11 at the crossing point P and which is in a plane perpendicular to the drum axis as pointed out hereinbefore, and this straight line 12 corresponds substantially to a path for the yarn which is delivered from the shallow groove "h" to the shallow groove "a".

Accordingly, at the time of this yarn delivery, the fan-shaped areas 6a defined by the straight line 12 on the upper edge of the inclined wall 6 are not brought into contact with the yarn and the inclined wall 6 falls in contact with the yarn at the point R. The yarn is guided from this point R along the guide edge 6b. Therefore, the recess 16a of the notch 13 formed on the guide edge 6a in the fan-shaped area does not constitute any hindrance to the delivery of the yarn. Incidentally, since the upper edge 7a of the side wall 7 of the groove "a" does not directly act as a yarn guide edge, no hindrance should naturally be constituted by the recess 15a of the notch 13. If a curved portion 16b smoothened in the yarn advance direction is formed on the recess 16a of the guide edge of the notch, even if the yarn is caused to intrude into the recess 16a for some reason or other, the yarn is not caught on the recess 16a but is allowed to escape from the recess 16a.

If a notch is formed so that the notch traverses the guide edge 6b on the right side of the above-mentioned straight line 12, when the delivered yarn is traversed to the right, the yarn is allowed to fall down into this notch, and smooth traversing can hardly be accomplished and there is a fear of occurrence of such troubles as disturbance of the yarn layer on the winding package and yarn breakage.

The notch-forming position shown in FIG. 2 is appropriate as the position for formation of the notch 13. This position will now be described in detail with reference to FIG. 4 which is a development of the drum surface. Traversing is ordinarily performed along a course indicated by arrows A through H, and gently inclined escape surfaces 6, 17 and 18 are formed at the groove crossing points O, P and Q to smoothen the delivery of the yarn. The upper edges 6a, 17a and 18a of these escape surfaces extended beyond the straight lines 12, 19 and 20 rectangular to the drum axis, which are drawn from the confronting shallow groove ends of the grooves having the escape surfaces toward the escaping surfaces, are located at positions lower by a distance S shown in FIG. 3 than other drum surfaces, whereby the delivery of the yarn can be performed very smoothly.

Figure 4:
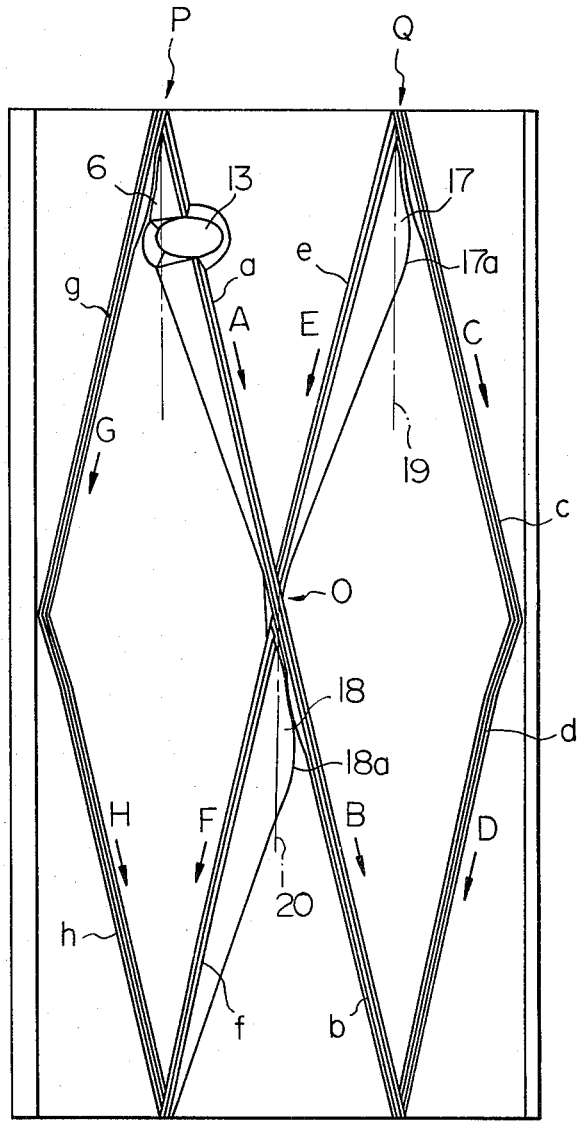
FIG. 4 is a development of the traverse drum shown in FIG. 2.

When the cut yarn end is wound on such grooves of the traverse drum, winding occurs substantially on the same grooves, that is, grooves "a" and "f" in FIG. 4. More specifically, when the cut yarn end adheres to, for example, the bottom surface of the groove "a", the yarn is guided in a direction indicated by an arrow A along the groove "a" by rotation of the drum and although the yarn is guided along the deep grooves "a" and "b" at ordinary traversing, when the yarn is wound on the drum, the yarn is guided toward the groove "f" at the crossing point O by the escape surface 18 and is guided in the direction indicated by an arrow F. Since the grooves "f" and "g" form a continuous groove, the yarn is ordinarily guided along arrows F and G at the crossing point P, but the yarn wound on the grooves "a" and "f" is not introduced into the groove "g" but is guided toward the groove "a" again at the crossing point P. Thus, the yarn is wound on the bottom surfaces of the grooves "a" and "f". When the cut yarn end adheres to the bottom surface of the groove "b", the yarn is guided in a direction indicated by an arrow B by rotation of the drum and is delivered to the crossing point Q. At this crossing point Q, the yarn is not guided in the ordinary guide direction but is guided into the groove "e" by the escape surface 17 and is advanced in a direction indicated by an arrow E. At the point Q, delivery of the yarn from the groove "e" to the groove "f" is caused by the escape surface 18, and the yarn is advanced in the groove "f". When the yarn is once wound on the groove "f", the yarn is wound on the grooves "f" and "a" in the same manner as described above.

Accordingly, when yarn breakage takes place and the yarn end is wound on the groove of the drum, ordinary traversing is not performed, and at the groove crossing points, the yarn end tends to intrude into the grooves having escape surfaces 6, 17 and 18, and therfore, the yarn is most likely to be wound on the grooves "a" and "f".

Accordingly, highest effect can be obtained when the wound yarn-removing notch is formed on the escape surface 6 of the groove "a" at the crossing point P or on the escape surface 18 of the groove "f" at the crossing point O. Of course, a notch similar to the above-mentioned notch 13 may also be formed on the escape surface 17 of the groove "e", and even if such notch is formed, the ordinary traversing operation is not hindered at all.

When the yarn end is thus wound on the drum 3, an L-shaped knife 21 is inserted into the notch 13 as shown in FIG. 3, and if the knife 21 is operated so that it traverses the groove "a" along the bottom surface 14 of the notch 13, the yarn Y1 wound on the groove bottom surface can be cut and removed. At this point, even if the knife 21 is moved from the side wall 15 to the side wall 16 along the bottom surface of the notch 13 and the side wall 15 or 16 is damaged more or less by contact with the knife 21, since the side walls 15 and 16 are retreated from the yarn guiding inclined wall surfaces 6 and 7, these side walls 15 and 16 are not brought into contact with the yarn and therefore, the yarn is not influenced by such damage. Accordingly, the operation of cutting and removing the wound yarn can be accomplished very easily and promptly without any special attention being paid thereto.

What is claimed is:

1. A traverse drum for use in a winding machine, said drum having a body of substantially circular cylindrical shape with an axis, wherein said drum has an endless guide groove means extending about and along a peripheral surface of said drum body, said guide groove means comprising a shallow groove and a deep groove with said shallow groove being cut and traversed by said deep groove at a crossing zone, with said deep groove being continuous, and wherein said shallow groove has two side walls with different angles of inclination, and wherein a top edge of one of said side walls of said shallow groove having a smaller angle of inclination, is disposed toward said deep groove and beyond a plane located perpendicular to said axis and extending from said shallow groove at substantially the area where said shallow groove is cut and traversed by said deep groove, and wherein said drum further comprises a wound yarn removing notch having at least one side wall, said notch being on said shallow groove with a top edge of said side wall of said notch, traversing said top edge of said shallow groove side wall.

2. The traverse drum of claim 1, wherein said notch has a bottom surface which is deeper than the bottom portion of said shallow groove, and wherein said notch is located on said shallow groove and forms two fan shaped areas surrounded by said top edge of said side wall of said shallow groove, said plane and said top edge of said side wall of said notch being formed at a position extended toward said deep groove beyond said plane.

3. The traverse drum of claim 2, wherein said top edge of said side wall of said shallow groove, in the vicinity of said fan shaped area, is located at a position which is lower than said drum surface.

* * * * *